US012649550B2

(12) United States Patent
Tang et al.

(10) Patent No.: US 12,649,550 B2
(45) Date of Patent: Jun. 9, 2026

(54) FULL-POSTURE UNDERWATER DRONE DEVICE AND LAYOUT METHOD

(71) Applicant: SHENZHEN QYSEA TECH CO., LTD, Shenzhen (CN)

(72) Inventors: Junping Tang, Shenzhen (CN); Chong Zhang, Shenzhen (CN); Zhuoru Zhong, Shenzhen (CN)

(73) Assignee: SHENZHEN QYSEA TECH CO., LTD, Shenzhen (CN)

( * ) Notice: Subject to any disclaimer, the term of this patent is extended or adjusted under 35 U.S.C. 154(b) by 459 days.

(21) Appl. No.: 18/122,711

(22) Filed: Mar. 17, 2023

(65) Prior Publication Data

US 2024/0239456 A1 Jul. 18, 2024

(30) Foreign Application Priority Data

Jan. 16, 2023 (CN) ..... 202320111654.6

(51) Int. Cl.
*B63G 8/00* (2006.01)
*B63G 8/16* (2006.01)

(52) U.S. Cl.
CPC ..... *B63G 8/001* (2013.01); *B63G 8/16* (2013.01); *B63G 2008/002* (2013.01)

(58) Field of Classification Search
CPC .... B63G 8/001; B63G 8/16; B63G 2008/002; B63G 2008/005
See application file for complete search history.

(56) References Cited

U.S. PATENT DOCUMENTS

D945,350 S 3/2022 Zhang et al.
2016/0114887 A1* 4/2016 Zhou ..... H04N 23/51 348/148
2022/0161911 A1 5/2022 Zhang et al.
2023/0088089 A1* 3/2023 Shen ..... B63G 8/08 114/330

(Continued)

FOREIGN PATENT DOCUMENTS

CN 104477359 A 4/2015
CN 206087176 U 4/2017
CN 107690406 A 2/2018

(Continued)

OTHER PUBLICATIONS

Translation CN-107690406-B (Year: 2025).*

(Continued)

*Primary Examiner* — J. T. Newton

(57) ABSTRACT

Disclosed is a full-posture underwater drone device, including: a shell, and six propellers installed on the shell, the six propellers are independently controlled, four of the propellers are respectively located in four spaces formed by a first vertical central plane and a second vertical central plane, a propelling direction is between a horizontal direction and a vertical direction, and the other two propellers are located on opposite sides of the first vertical central plane; the first vertical central plane extends along a front-rear direction of the shell and is perpendicular to a horizontal plane, and the second vertical central plane passes through a midpoint in a longitudinal direction of the shell and is perpendicular to the first vertical central plane and the horizontal plane.

8 Claims, 5 Drawing Sheets

(56) References Cited

U.S. PATENT DOCUMENTS

| | | | | |
|---|---|---|---|---|
| 2024/0239456 | A1* | 7/2024 | Tang | B63G 8/16 |
| 2024/0317373 | A1* | 9/2024 | Zhang | B63G 8/08 |

FOREIGN PATENT DOCUMENTS

| | | | | | |
|---|---|---|---|---|---|
| CN | 107933857 | A | | 4/2018 | |
| CN | 108674614 | A | | 10/2018 | |
| CN | 107690406 | B | * | 6/2019 | B63H 21/17 |
| CN | 109911157 | A | | 6/2019 | |
| CN | 209972747 | U | | 1/2020 | |
| CN | 215155549 | U | | 12/2021 | |
| CN | 219361305 | U | | 7/2023 | |
| JP | 2022136346 | A | | 9/2022 | |
| JP | 2022146995 | A | | 10/2022 | |
| WO | 8907071 | A2 | | 8/1989 | |
| WO | 2018117925 | A1 | | 6/2018 | |
| WO | 2019028692 | A1 | | 2/2019 | |
| WO | 2019028693 | A1 | | 2/2019 | |

OTHER PUBLICATIONS

The first Office Action, dated May 20, 2025, in counterpart Japan Application No. 2024-518653.
The European search report, dated Sep. 30, 2025, in counterpart Europe Application No. 24708342.1-1009.

* cited by examiner

FULL-POSTURE UNDERWATER DRONE DEVICE AND LAYOUT METHOD

CROSS-REFERENCE TO RELATED APPLICATIONS

This application claims priority to Chinese Patent Application No. 202320111654.6, filed on Jan. 16, 2023, the entire contents of which are incorporated herein by reference.

TECHNICAL FIELD

The present disclosure relates to the technical field of robots, in particular to a full-posture underwater drone device and layout method.

BACKGROUND

With the development of science and technology, the related technology of full-posture underwater drone devices has also developed. Many full-posture underwater drone devices can hover and move forward and backward at any angle underwater. However, many existing full-posture underwater drone devices with the ability to hover and move forward and backward are controlled by motors, that is, at least 8 motors are needed to realize the above functions, which increases the manufacturing cost of these full-posture underwater drone devices.

SUMMARY

The main objective of the present disclosure is to provide a full-posture underwater drone device, which aims to reduce the quantity of motors used by the full-posture underwater drone device with the functions of hovering and overturning over at any angle, and then reduce the manufacturing cost.

In order to achieve the above objective, the present disclosure provides a full-posture underwater drone device, including: a shell, and six propellers installed on the shell, the six propellers are independently controlled, four of the propellers are respectively located in four spaces formed by a first vertical central plane and a second vertical central plane, a propelling direction is between a horizontal direction and a vertical direction, and the other two propellers are located on two sides of the first vertical central plane;

the first vertical central plane extends along a front-rear direction of the shell and is perpendicular to a horizontal plane, and the second vertical central plane passes through a midpoint in a longitudinal direction of the shell and is perpendicular to the first vertical central plane and the horizontal plane.

In an embodiment, the propeller is detachably connected to the shell.

In an embodiment, the shell is provided with six accommodating grooves matching with the propellers, the propellers are installed in the accommodating grooves in a one-to-one correspondence, and the propellers are installed in the accommodating groove at various angles.

In an embodiment, the full-posture underwater drone device has a plurality of working modes, the working modes include hovering mode, longitudinal overturning motion mode, circumferential overturning motion mode, lateral overturning motion mode, and linear motion mode, when the full-posture underwater drone device is in any one of the working modes, the six propellers are all in working condition.

In an embodiment, when the full-posture underwater drone device is in the longitudinal overturning motion mode, directions of resultant forces of the propellers located on both sides of the second vertical central plane acting on the shell are opposite, and the directions of the two resultant forces are parallel to the first vertical central plane.

In an embodiment, when the full-posture underwater drone device is in the circumferential overturning motion mode, directions of resultant forces of the propellers located on both sides of the first vertical central plane acting on the shell are opposite, and the directions of the two resultant forces are parallel to the second vertical central plane.

In an embodiment, when the full-posture underwater drone device is in the lateral overturning motion mode, directions of resultant forces of the propellers located on both sides of the first vertical central plane acting on the shell are opposite, and the directions of the two resultant forces are parallel to the horizontal plane.

In an embodiment, the propellers on both sides of the first vertical central plane are symmetrical.

In an embodiment, propelling directions of the propellers in two diagonally provided spaces among the four spaces are the same.

In an embodiment, the propeller is reversely propelled through reverse rotating.

In the present disclosure, the first vertical central plane, the second vertical central plane and the horizontal plane respectively pass through the center line of the corresponding shell surface. It should be noted that the six propellers are independently controlled, namely the propelling speed and propelling force of each propeller, and the cooperation and linkage between each propeller can be individually controlled and adjusted correspondingly. It can be understood that since there are two propellers whose direction is consistent with that of the front end of the shell and are located on the opposite sides of the first vertical central plane, the full-posture underwater drone device can move forward and backward through the two propellers, and since the propelling directions of the remaining four propellers are between the horizontal direction and the vertical direction, and the propelling force of these four propellers can be controlled independently, the direction of the resultant force of these four propellers can be directed towards any direction except the front-rear direction, that is, the four propellers can realize that the shell is propelled in any direction except the front-rear direction.

When the full-posture underwater drone device moves forward and backward, it is parallel to the horizontal plane, and the front-rear direction in the present disclosure is consistent with the extension direction of the shell, and is perpendicular to the left-right direction.

Therefore, it is understandable that the technical solution can hover and move forward and backward at any angle through six propellers, one propeller corresponds to one motor, which correspondingly reduces the quantity of motors used in the full-posture underwater drone device with functions of hovering and moving forward and backward at any angle, thereby reducing the manufacturing costs.

BRIEF DESCRIPTION OF THE DRAWINGS

In order to more clearly illustrate the technical solutions in the embodiments of the present disclosure or in the related art, drawings used in the embodiments or in the related art will be briefly described below. Obviously, the drawings in the following description are only some embodiments of the present disclosure. It will be apparent to those skilled in the art that other figures can be obtained according to the structures shown in the drawings without creative work.

Figure 1:
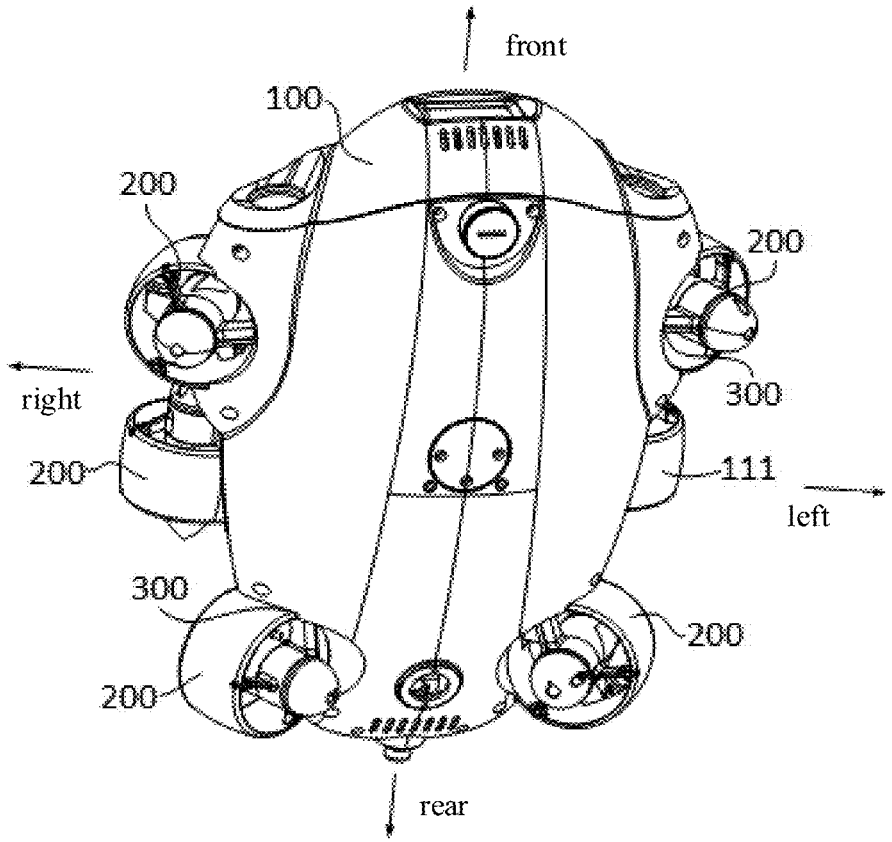
FIG. 1 is a schematic structural view of a full-posture underwater drone device at a certain angle according to an embodiment of the present disclosure.
Figure 2:
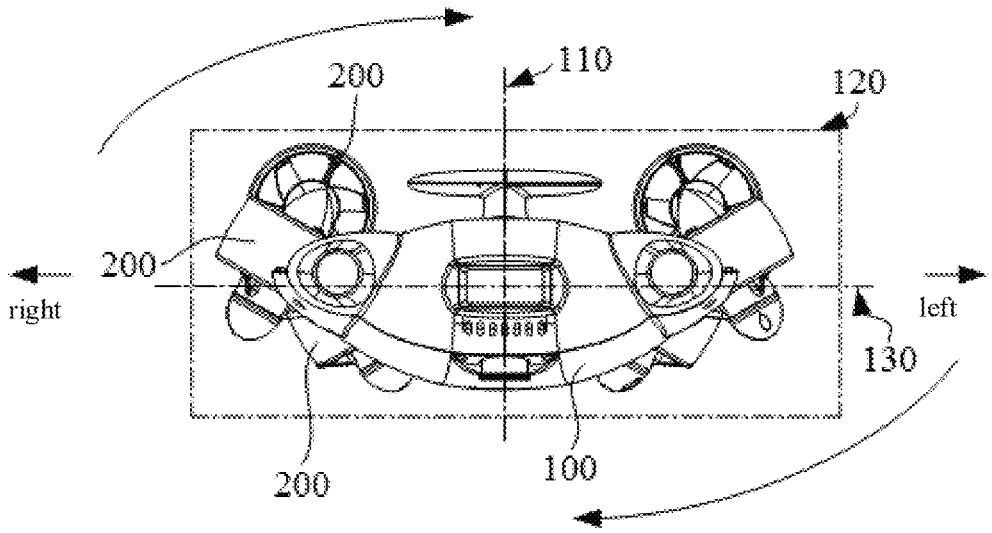
FIG. 2 is a schematic structural view of the full-posture underwater drone device in a circumferential overturning motion mode of the present disclosure.
Figure 3:
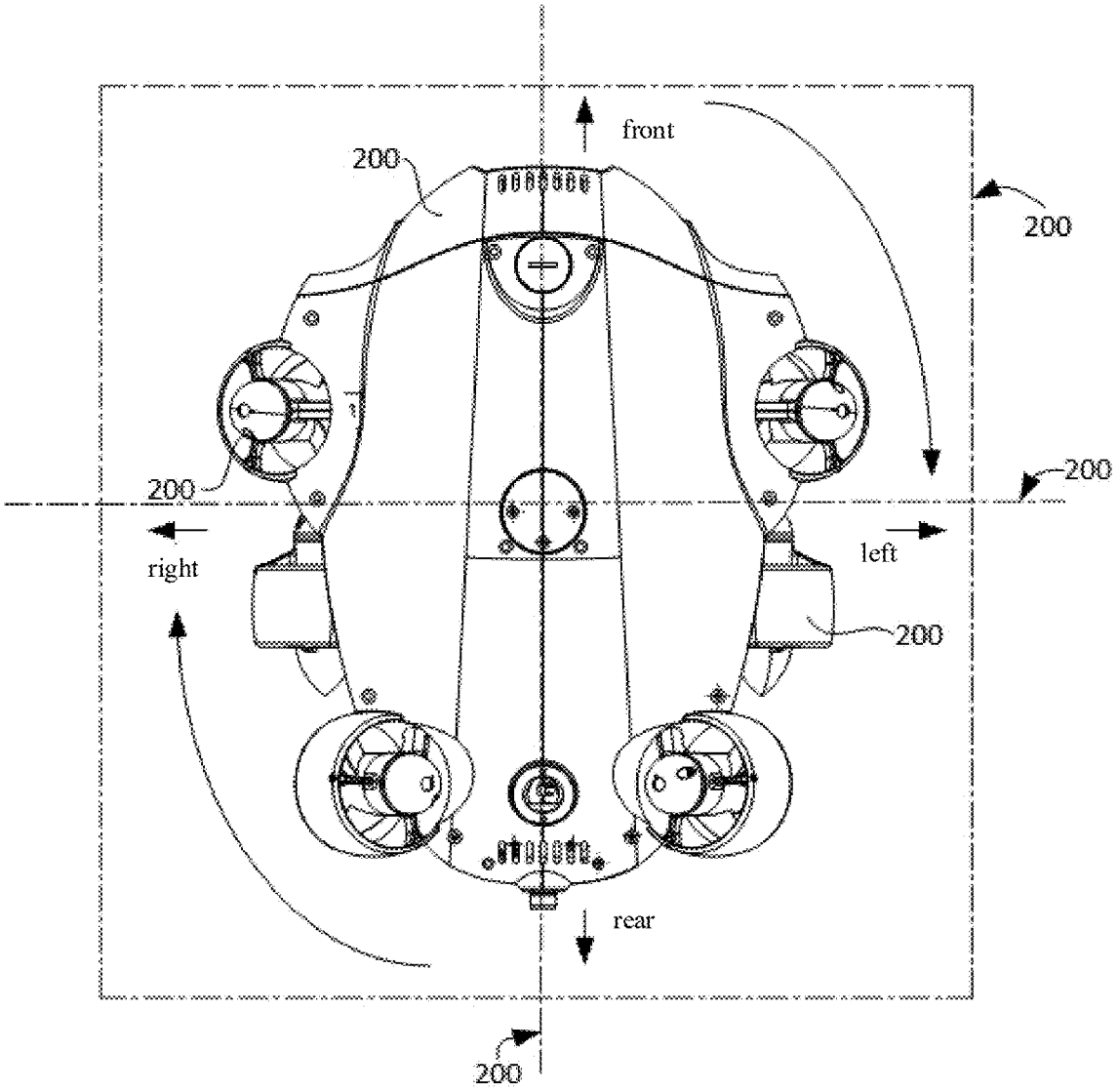
FIG. 3 is a schematic structural view of the full-posture underwater drone device in a lateral overturning motion mode of the present disclosure.
Figure 4:
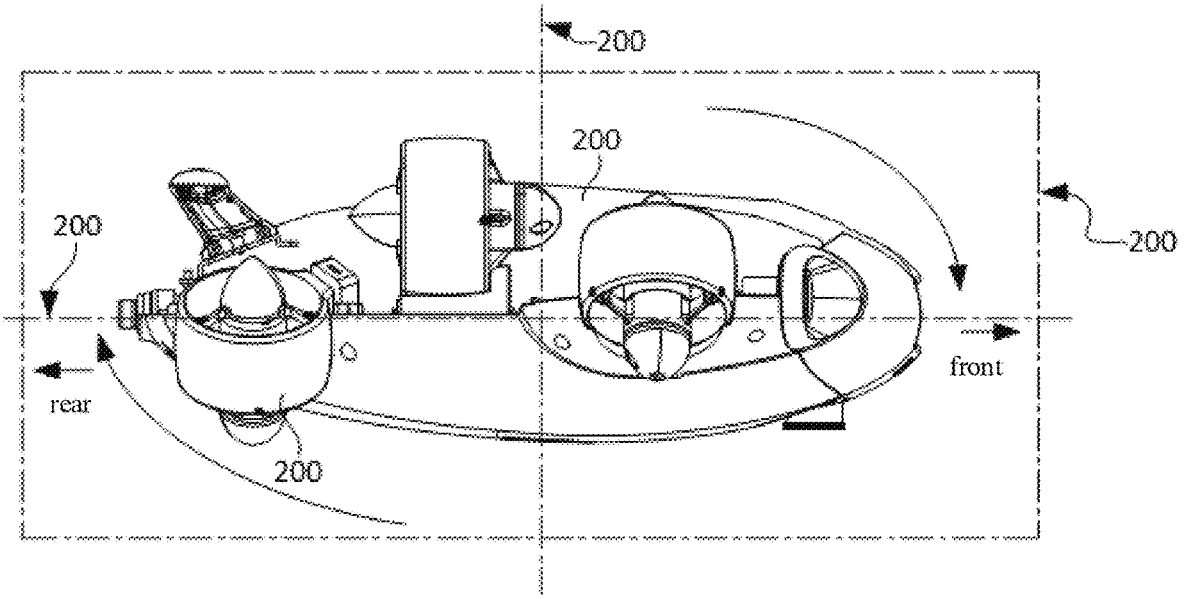
FIG. 4 is a schematic structural view of the full-posture underwater drone device in a longitudinal overturning motion mode of the present disclosure.

The realization of the objective, functional characteristics, and advantages of the present disclosure are further described with reference to the accompanying drawings.

DETAILED DESCRIPTION OF THE EMBODIMENTS

The technical solutions of the embodiments of the present disclosure will be described in more detail below with reference to the accompanying drawings. It is obvious that the embodiments to be described are only some rather than all of the embodiments of the present disclosure. All other embodiments obtained by persons skilled in the art based on the embodiments of the present disclosure without creative efforts shall fall within the scope of the present disclosure.

It should be noted that all of the directional instructions in the embodiments of the present disclosure (such as, up, down, left, right, front, rear . . . ) are only used to explain the relative position relationship and movement of each component under a specific attitude (as shown in the drawings), if the specific attitude changes, the directional instructions will change correspondingly.

In the present disclosure, unless otherwise specified and limited, the terms "connection" and "fixation" should be understood in a broad sense, for example, "fixation" can be a fixed connection, a detachable connection, or an integration; It may be a mechanical connection or an electrical connection; it may be a direct connection or an indirect connection through an intermediary, and it may be an internal communication between two elements or an interaction relationship between two elements, unless otherwise clearly defined. Those of ordinary skill in the art can understand the specific meanings of the above terms in the present utility model according to specific situations.

Besides, the descriptions in the present disclosure that refer to "first," "second," etc. are only for descriptive purposes and are not to be interpreted as indicating or implying relative importance or to implicitly indicate the number of technical features indicated. Thus, a feature defined as "first" or "second" may explicitly or implicitly include at least one of the features. In addition, technical solutions between the embodiments can be combined with each other, but must be based on the realization of the technical solutions by those skilled in the art, and when the technical solutions are contradictory to each other or cannot be realized, the technical solutions should be considered that the combination does not exist, and the technical solutions are not fallen within the protection scope claimed in the present disclosure.

As shown in FIG. 1 to FIG. 5: the present disclosure provides a full-posture underwater drone device.

In the embodiments of the present disclosure, the full-posture underwater drone device includes a shell and six propellers 200.

The six propellers 200 are installed on the shell 100, the six propellers 200 are independently controlled, four of the propellers 200 are respectively located in four spaces formed by a first vertical central plane 110 and a second vertical central plane 120, a propelling direction is between a horizontal direction and a vertical direction, and the other two propellers 200 are located on opposite sides of the first vertical central plane 110.

The first vertical central plane 110 extends along the front-rear direction of the shell 100 and is perpendicular to the horizontal plane 130, and the second vertical central plane 120 passes through a midpoint in the longitudinal direction of the shell 100 and is perpendicular to the first vertical central plane 110 and the horizontal plane 130.

In the technical solution of the present disclosure, the first vertical central plane 110, the second vertical central plane 120, and the horizontal plane 130 pass through a center line of the corresponding shell 100 respectively. It should be noted that the six propellers 200 are all independently controlled, that is, the propelling speed and propelling force of each propeller 200, and the linkage between the propellers 200 can be controlled and adjusted correspondingly. It can be understood that since there are two propellers 200 whose direction is consistent with that of the front end of the shell 100 and located on opposite sides of the first vertical central plane 110, the full-posture underwater drone device can move forward and backward through the two propellers 200, and since the propelling directions of the remaining four propellers 200 are between the horizontal direction and the vertical direction, and the propelling force of the four propellers 200 can be controlled independently, the direction of the resultant force of these four propellers 200 can be directed towards any direction except the front-rear direction, that is, the four propellers 200 can realize that the shell 100 is propelled in any direction except the front-rear direction.

Therefore, it can be understood that the technical solution can hover and move forward and backward at any angle through six propellers 200, one propeller 200 corresponds to one motor, which correspondingly reduces the quantity of motors used in the full-posture underwater drone device with functions of hovering and moving forward and backward at any angle, thereby reducing the related manufacturing costs.

Further, the propeller 200 is detachably connected to the shell 100. The propeller 200 and the shell 100 are detachably connected. It can be understood that the propeller 200 can exist independently of the shell 100, and accordingly the propeller 200 can be repaired and maintained more conveniently. Certainly, in other embodiments, the shell 100 may also be integrally formed with the propeller 200 during manufacture.

Figure 5:
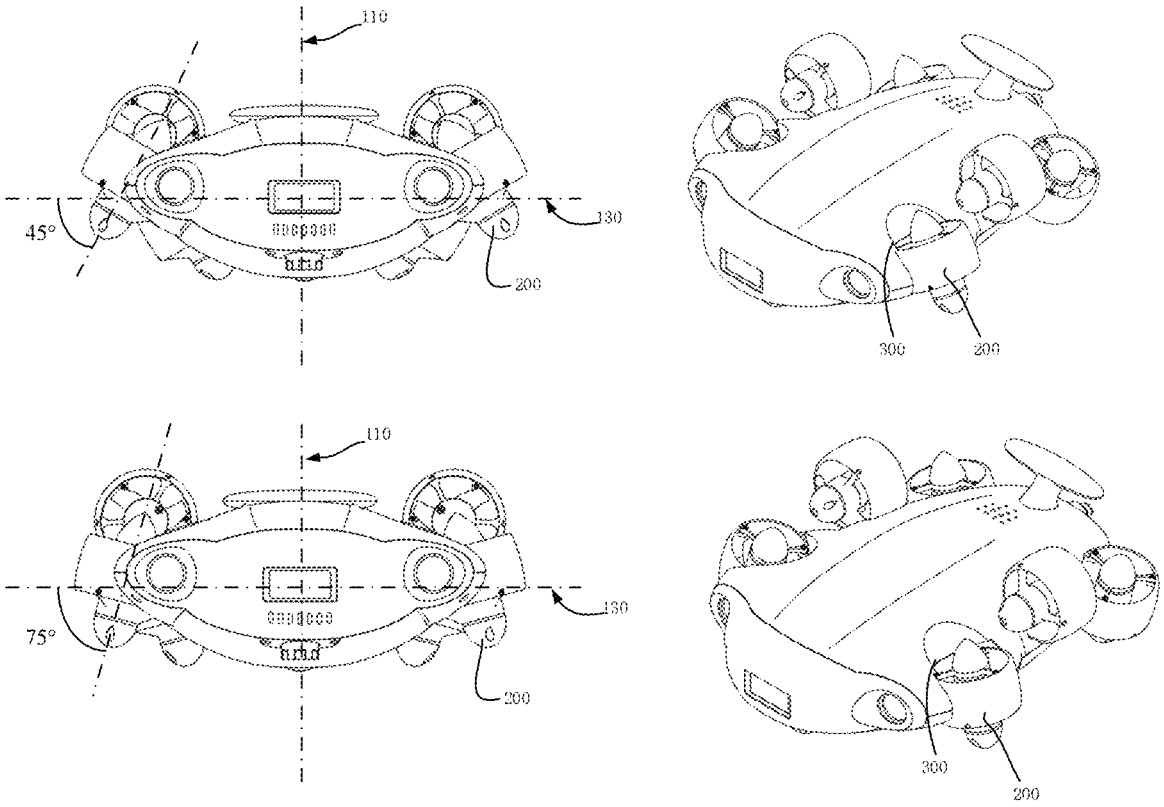
FIG. 5 is a schematic structural view of propellers at different installation angles.

Further, as shown in FIG. 5, the shell 100 is provided with six accommodating grooves 300 matching with the propellers 200, the propellers 200 are installed in the accommodating grooves 300 in a one-to-one correspondence, and the propellers 200 can be installed in the accommodating groove 300 at various angles. That is, four of the propellers 200 respectively located in the four spaces formed by the first vertical central plane 110 and the second vertical central plane 120 are installed in the accommodating grooves 300 in an adjustable angle, and the propelling directions of the four propellers 200 are adjustable between the horizontal direction and the vertical direction. In this embodiment, there are various relative positional relationships between the propeller 200 and the shell 100. It can be understood that the closer the propeller 200 is to the vertical direction of the shell 100, the greater the force applied by the propeller 200 to the shell 100 in the vertical direction is. Accordingly, the closer the propeller 200 is to the horizontal direction of the shell 100, the greater the force applied by the propeller 200 to the shell 100 in the horizontal direction is. The user can adjust a proper positional relationship between the propeller 200 and the shell 100 according to the actual environmental requirements.

Further, the full-posture underwater drone device has a plurality of working modes: hovering mode, longitudinal overturning motion mode, circumferential overturning motion mode, lateral overturning motion mode, and linear motion mode, when the full-posture underwater drone device is in any one of the working modes, the six propellers 200 are all in working condition. In this embodiment, the full-posture underwater drone device has the plurality of working modes; the hovering mode enables the full-posture underwater drone device to hover at any position underwater; the longitudinal overturning motion mode, circumferential overturning motion mode and lateral overturning motion mode enable the full-posture underwater drone device to overturn in any vertical or horizontal direction; the linear motion mode allows the full-posture underwater drone device to move forward or backward in any direction. It should be noted that when the full-posture underwater drone device is in any working mode, the six propellers 200 are all in working condition, but the resultant propelling force during working is different in direction and magnitude.

Further, when the full-posture underwater drone device is in the longitudinal overturning motion mode, directions of resultant forces of the propellers 200 located on both sides of the second vertical central plane 120 acting on the shell 100 are opposite, and the directions of the two resultant forces are parallel to the first vertical central plane 110. It can be understood that, in this embodiment, the directions of the two resultant forces on both sides of the second vertical central plane 120 and parallel to the first vertical central plane 110 are opposite, so that the full-posture underwater drone device can rotate around an intersecting axis of the horizontal plane 130 and the second vertical central plane 120, i.e., longitudinal rotation.

Further, when the full-posture underwater drone device is in the circumferential overturning motion mode, directions of resultant forces of the propellers 200 located on both sides of the first vertical central plane 110 acting on the shell 100 are opposite, and the directions of the two resultant forces are parallel to the second vertical central plane 120. It can be understood that, in this embodiment, the directions of the two resultant forces on both sides of the first vertical central plane 110 and parallel to the second vertical central plane 120 are opposite, so that the full-posture underwater drone device can rotate around an intersecting axis between the horizontal plane 130 and the first vertical central plane 110, i.e., circumferential rotation.

Further, when the full-posture underwater drone device is in the lateral overturning motion mode, directions of resultant forces of the propellers 200 located on both sides of the first vertical central plane 110 acting on the shell 100 are opposite, and the directions of the two resultant forces are parallel to the horizontal plane 130. It can be understood that, in this embodiment, the directions of the two resultant forces parallel to the horizontal plane 130 are opposite, and the full-posture underwater drone device can rotate around an intersecting axis between the first vertical central plane 110 and the second vertical central plane 120, i.e., lateral rotation.

Further, the propellers 200 on both sides of the first vertical central plane 110 are symmetrical. In this embodiment, the propellers 200 on both sides of the first vertical central plane 110 are provided symmetrically, so that the weight distribution of the shell 100 on the propellers 200 is relatively balanced, thereby ensuring the balance of the shell 100, reducing the control difficulty of full-posture underwater drone devices.

Further, the propelling directions of the propellers 200 in two diagonally provided spaces among the four spaces are the same. In this embodiment, among the four propellers 200 in the four spaces formed by the first vertical central plane 110 and the second vertical central plane 120, the propelling directions of the propellers 200 provided diagonally are the same. It can be understood that since the propellers 200 on both sides of the first vertical central plane 110 are symmetrical, the propelling directions of the propellers 200 on both sides of the first vertical central plane 110 are opposite, and because the propelling directions of propellers 200 provided diagonally are the same, the propellers 200 on the same side of the first vertical central plane 110 are also provided opposite to each other, which makes the resultant force direction of the propellers 200 more combined and effective in distribution, thus is correspondingly more conducive to the control of the full-posture underwater drone device.

Further, the propeller 200 can be reversely propelled through reverse rotation. In this embodiment, the propeller 200 can rotate forward or reversely. It should be noted that the direction of the propelling force is opposite when the propeller 200 rotates forward and reverse, and the direction of propelling is also opposite accordingly, the reverse function enables the full-posture underwater drone device to have more path choices in control, thereby improving the control convenience of the full-posture underwater drone device.

The above are only some embodiments of the present disclosure, and do not limit the scope of the present disclosure thereto. Under the inventive concept of the present disclosure, equivalent structural transformations made according to the description and drawings of the present disclosure, or direct/indirect application in other related technical fields are included in the scope of the present disclosure.

What is claimed is:

1. A full-posture underwater drone device, comprising:

a shell; and six propellers installed on the shell, wherein the six propellers are independently controlled, four of the propellers are respectively located in four spaces formed by a first vertical central plane and a second vertical central plane, a propelling direction is between a horizontal direction and a vertical direction, and other two of the propellers are located on either side of the first vertical central plane;

wherein the first vertical central plane extends along a front-rear direction of the shell and is perpendicular to a horizontal plane, and the second vertical central plane passes through a midpoint in a longitudinal direction of the shell and is perpendicular to the first vertical central plane and the horizontal plane;

the full-posture underwater drone device has a plurality of working modes, the working modes comprise hovering mode, longitudinal overturning motion mode, circumferential overturning motion mode, lateral overturning motion mode, and linear motion mode, when the full-posture underwater drone device is in any one of the working modes, the six propellers are all in operation; and the shell is provided with six accommodating grooves matching with the propellers, the propellers are installed in the accommodating grooves in a one-to-one correspondence, four of the propellers respectively located in the four spaces formed by the first vertical central plane and the second vertical central plane are installed in the accommodating grooves in an adjustable angle, and the propelling directions of the four propellers are adjustable between the horizontal direction and the vertical direction.

2. The full-posture underwater drone device according to claim 1, wherein the propeller is detachably connected to the shell.

3. The full-posture underwater drone device according to claim 1, wherein when the full-posture underwater drone device is in the longitudinal overturning motion mode, directions of resultant forces of the propellers located on both sides of the second vertical central plane acting on the shell are opposite, and the directions of the two resultant forces are parallel to the first vertical central plane.

4. The full-posture underwater drone device according to claim 1, wherein when the full-posture underwater drone device is in the circumferential overturning motion mode, directions of resultant forces of the propellers located on both sides of the first vertical central plane acting on the shell are opposite, and the directions of the two resultant forces are parallel to the second vertical central plane.

5. The full-posture underwater drone device according to claim 1, wherein when the full-posture underwater drone device is in the lateral overturning motion mode, directions of resultant forces of the propellers located on both sides of the first vertical central plane acting on the shell are opposite, and the directions of the two resultant forces are parallel to the horizontal plane.

6. The full-posture underwater drone device according to claim 1, wherein the propellers on both sides of the first vertical central plane are symmetrical.

7. The full-posture underwater drone device according to claim 6, wherein propelling directions of the propellers in two diagonally provided spaces among the four spaces are the same.

8. The full-posture underwater drone device according to claim 1, wherein the propeller is reversely propelled through reverse rotating.

* * * * *